US005564251A

United States Patent [19]

Van Bers

[11] Patent Number: 5,564,251

[45] Date of Patent: Oct. 15, 1996

[54] METHOD OF LAYING A FLOOR

[75] Inventor: Frederik J. Van Bers, Eindhoven, Netherlands

[73] Assignee: OSBE Parket B.V., Eindhoven, Netherlands

[21] Appl. No.: 358,517

[22] Filed: Dec. 19, 1994

[30] Foreign Application Priority Data

Jun. 15, 1993 [NL] Netherlands ..... 9301034

[51] Int. Cl.[6] ..... E04B 1/10

[52] U.S. Cl. ..... 52/747.11; 52/746.1; 52/745.21; 52/390; 52/177

[58] Field of Search ..... 52/177, 390, 747.11, 52/391, 392, 745.21, 746.1, 223.1; 156/505, 516

[56] References Cited

U.S. PATENT DOCUMENTS 4,557,475 12/1985 Donovan ..... 52/177 X
4,674,245 6/1987 Turner ..... 52/177
5,067,298 11/1991 Petersen .
5,331,787 7/1994 Paulitschke et al. ..... 52/746.1
5,357,724 10/1994 Sonoda ..... 52/177 X

FOREIGN PATENT DOCUMENTS 1040382 10/1978 Canada ..... 52/747.11

*Primary Examiner*—Carl D. Friedman
*Assistant Examiner*—W. Glenn Edwards
*Attorney, Agent, or Firm*—Oblon, Spivak, McClelland, Maier & Neustadt, P.C.

[57] ABSTRACT

A method of laying a floor wherein the floor is built up of parts butting together at edge portions thereof and, which are laid on a subfloor. A layer formed of one of an elastic and/or resilient material is provided on at least part of a subfloor in a taut condition. Parts butting against each other are successively glued onto the layer of a resilient material. The layer of one of an elastic and resilient material may at an upper side thereof be provided with an adhesive layer covered by paper or a paper like material.

5 Claims, 1 Drawing Sheet

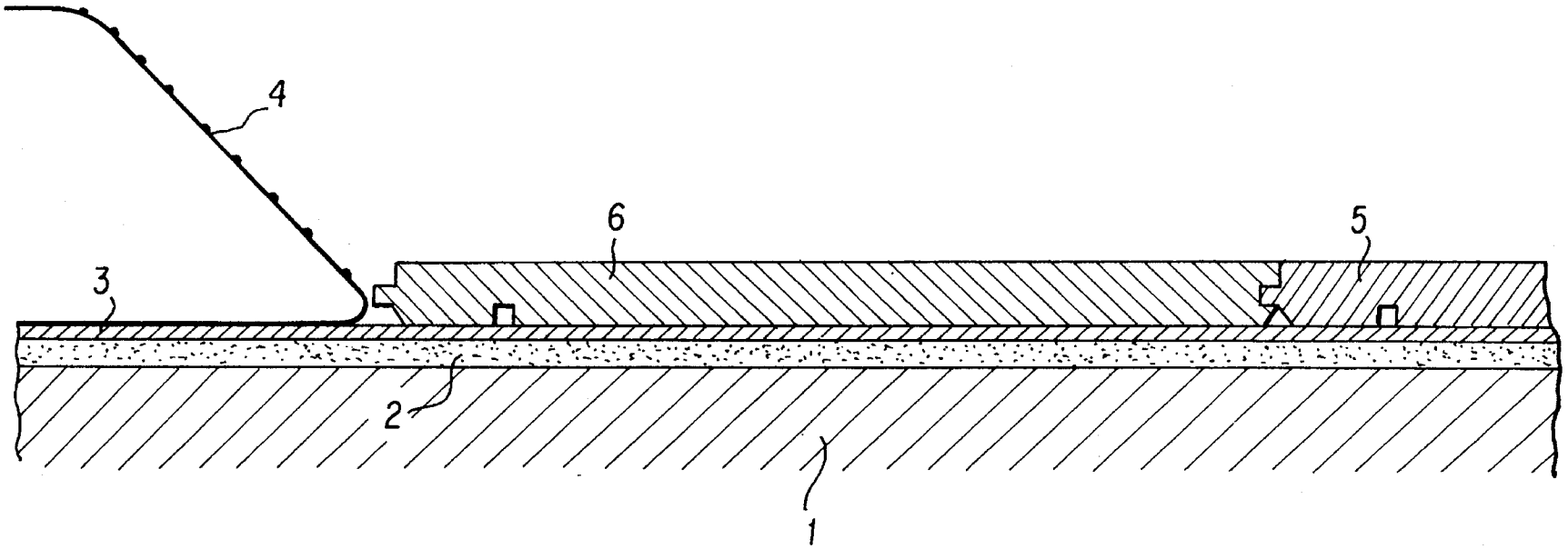
5
6
4
3
2
1

METHOD OF LAYING A FLOOR

BACKGROUND OF THE INVENTION

Field of the Invention

The invention relates to a method of laying a floor which is built up of parts butting together with their edges, which are laid on a subfloor.

SUMMARY OF THE INVENTION

The purpose of the invention is to obtain a method wherein it is possible to provide the parts, closely butting together, on the subfloor in a simple manner.

According to the invention this may be achieved in that a layer consisting of an elastic and/or resilient material is provided on at least part of a subfloor in a taut (i.e. stretched or under tension) condition, and that parts butting on each other are successively glued onto said layer consisting of an elastic and/or resilient material.

By adhering or glueing the parts generally consisting of wood or the like material entirely or partly on a layer consisting of an elastic and/or resilient material it may be achieved that the parts are constantly pulled together under tension by the layer consisting of an elastic and/or resilient material, thus preventing the formation of cracks and the like between the parts as a result of shrinking and/or swelling caused by changes in the air humidity.

The invention will be explained in greater detail hereafter with reference to the accompanying Figures, which diagrammatically shows a sectional view of a part of a floor during its laying.

The Figure shows the usual subfloor 1 present in a building or the like, which is in many cases a concrete floor provided with a finishing layer, but which may for example also be a wooden subfloor or the like.

On this subfloor a layer 2 consisting of an elastic and/or resilient material has been provided. Said sublayer 2 may be a layer, which may or may not be massive, of plastic material and/or rubber having open or closed cells.

When being laid on the subfloor 1, covering the subfloor 1 entirely or partly, for example in strips, said layer 2 of an elastic and/or resilient material is pulled quite taut and fixed to the subfloor in its taut condition. Said fixing to the subfloor 1 of the layer 2 consisting of an elastic and/or resilient material may be done in an efficient manner by glueing said layer 2 to the floor 1. For this purpose the layer 2 may be provided with an adhesive layer (not shown) on its bottom side, which may be covered by a layer of paper or the like prior to the layer 2 being applied to the floor 1.

Furthermore it is possible to partly fix the layer 2 to the subfloor 1 in its taut condition by means of double-sided adhesive strips, which might be removed after the floor parts have been laid.

It is noted that in many cases it is not absolutely necessary to fix the layer 2 to the subfloor 1, since the layer 2 consisting of an elastic and/or resilient material is supplied in an already sufficiently taut condition on paper.

At its upper side the layer 2 consisting of an elastic and/or resilient material is provided with an adhesive layer 3, which for the sake of clarity is shown considerably thicker in the Figure than it actually is in reality.

Prior to the laying of the floor said adhesive layer is conventionally covered with a protective layer 4 consisting of paper or the like.

After the layer 2 consisting of an elastic and/or resilient material, which is covered with the protective layer 4 at its upper side, has been provided on the subfloor 1 in the above-described manner, the paper is pulled off the layer 2 near one end, over a width which approximately corresponds with the width of the first part 5 of the floor, which is subsequently glued to the layer 2 by means of the adhesive layer 3.

The pulled-off part of the layer of paper is folded back and laid on top of the part of the layer 4 still adhering to the layer 2. The next part 6 to be provided is laid on said folded-back part of the layer of paper 4 and firmly pressed against the first part 5. When the abutting edges of the parts are provided with a tongue and a groove, as is the case in the illustrated embodiment, said edges will be tightly driven one into another when the successive parts are being laid.

After the part 6 has thus been firmly pressed against the part 5 the layer of paper 4 may be pulled out from under the part 6, as a result of which the part 6 comes in direct contact with the adhesive layer 3 and is thus adhered to the layer 2. The next part of the floor may be provided in a similar manner again, so that eventually all the parts are adhered, tightly butting against each other, to the taut layer 2 consisting of an elastic and/or resilient material..

It will be apparent that thus the laying of the floor parts 5, 6 can be achieved in a simple and quick manner, while said floor parts will be pulled together under tension by the layer 2 consisting of an elastic and/or resilient material, possibly after the adhesive strips have been removed from under said layer. With floors consisting of wooden parts 5, 6 the wooden parts usually have a low moisture content on being supplied. As a result of this said parts, once laid, will be subject to swelling because generally their moisture content will increase, as a result of which said parts will butt even more tightly together.

Even though the above description refers to wooden parts 5, 6, it will be apparent that said parts may also consist of another material, for example of a plastic material, cork or the like, while said parts may also have different shapes and do not necessarily have to be elongated planks.

Surprisingly it has appeared that when the construction according to the invention is used, a considerable improvement with regard to preventing annoying air and contact noises is achieved in comparison with known construction, while furthermore advantageous thermal properties are obtained.

Obviously, numerous modifications and variations of the present invention are possible in light of the above teachings. It is therefore to be understood that within the scope of the appended claims, the invention may be practiced otherwise than as specifically described herein.

I claim:

1. A method of laying a floor formed of parts butting together at the edges thereof, said parts being laid on a subfloor, said method comprising:

providing on the subfloor a taut layer of at least one of an elastic and a resilient material and gluing the parts butting against each other onto said taut layer of material.

2. A method of according to claim 1, which comprises:

providing an upper side of said layer with an adhesive layer covered by one of paper and a paper-like material, and removing said material from said adhesive layer prior to laying a first part of said parts on said taut layer and folding back said material from said adhesive layer and laying said folded back material on the top of part of the material still covering said adhesive layer prior to said first part being laid on said taut layer, after which a second part is laid;

laying the second part on the folded-back material and pressing the second part against the first part so as to butt tightly against said first part, and pulling away the material from under said second part.

3. A method according to claim 1, wherein said taut layer of material is laid on one of the entire surface and on portions of the surface of the subfloor in a taut condition.

4. A method according to claim 1, wherein said taut layer of material on the subfloor is provided on a bottom side thereof with an adhesive layer bonding the material to the subfloor.

5. A method according to claim 1, wherein said taut layer of material on the subfloor is provided with a protective layer of paper on a bottom side thereof.

* * * * *